United States Patent [19]

Shishoo

[11] 4,199,916

[45] Apr. 29, 1980

[54] METHOD OF TREATING FIBROUS MATERIALS

[75] Inventor: Roshan L. Shishoo, Askim, Sweden

[73] Assignee: Tex Innovation AB, Vastra Frolunda, Sweden

[21] Appl. No.: 847,666

[22] Filed: Nov. 1, 1977

Related U.S. Application Data

[63] Continuation-in-part of Ser. No. 735,551, Nov. 1, 1976, abandoned.

[51] Int. Cl.[2] ..... B65B 31/00

[52] U.S. Cl. ..... 53/434; 8/149.2; 34/12

[58] Field of Search ..... 53/21 FC, 22 B; 8/130.1, 149.2, 150; 34/12; 53/428, 434

[56] References Cited

U.S. PATENT DOCUMENTS 3,961,458 6/1976 Shishoo et al. ..... 53/21 FC

OTHER PUBLICATIONS

L. Waesterberg, Journal of the Textile Institute—Shape-Retention of Garments Under Conditions of Changing Humidity—pp. T433-T444.

*Primary Examiner*—Travis S. McGehee

*Attorney, Agent, or Firm*—Lawrence I. Field

[57] ABSTRACT

A method of treating fibrous material such as textile products, e.g. garments or the like, which may be compressible, so as to permit the product to have improved wrinkle resistance particularly when such products are vacuum packaged or otherwise, wrinkling would occur. The method involves treating the material to reduce the segment mobility level of the fibrous material to a point below that prior to treatment and to lower the relative regain level of the material. The method also involves lowering, for fibrous materials, regain levels of such materials to preferably below 0.27. In the methods, the segment mobility and regain levels are preferably stabilized under a stabilization step before packaging.

26 Claims, 9 Drawing Figures

DECREASE IN WEIGHT (%)
0
1
2
3
4
5
6
7
8
E
F
0 5 15 30 60 90 120
CONDITIONING TIME (MIN.)

MOISTURE REGAIN (%)
10
8
6
4
2
0
A
B
0 5 15 30 60 90 120
DEHUMIDIFYING TIME (MIN.)

MOISTURE REGAIN (%)
6
5
4
3
2
1
0
C
D
0 5 10 15 30 60 90 120
DEHUMIDIFYING TIME (MIN.)

WRINKLE HEIGHT (MM)
0
1
2
3
4
5
6
7
8
9
G
H
I
J
K
L
NYLON
COTTON
COTTON/PES.
WOOL
WOOL/PES.
PES.
5 10
30
60
120
180
CONDITIONING TIME (MIN.)

WRINKLE HEIGHT (MM)
0
1
2
3
4
5
6
G'
H'
I'
J'
K'
L'
COTTON
COTTON/PES.
NYLON
WOOL/PES.
WOOL
PES.
5 10
30
60
120
180
CONDITIONING TIME (MIN.)

METHOD OF TREATING FIBROUS MATERIALS

This application is a continuation-in-part of copending U.S. application Ser. No. 735,551, filed Nov. 1, 1976 now abandoned.

This invention relates to conditioning materials for subsequent vacuum packaging.

In U.S. Pat. No. 3,961,458, June 8, 1977, entitled "PRETREATMENT, PACKING, STORING AND FINISHING TREATMENT OF TEXTILE MATERIAL PRODUCTS" there is taught a method relating to the pretreatment of various textile products. As disclosed, a major problem relating to the conventional attempts to wrap textile products in vacuum packages is that upon removing the product from the vacuum package, it will tend to have semi-permanent wrinkles which involves the use of subsequent steps to render the product suitable for consumer sale, particularly in the case of products such as garments. More specifically, it is well known to those skilled in this art that when garments are vacuum packaged, the tendency of the garment to develop semi-permanent wrinkles set into the material of the garment is quite severe due to the wrinkling effect created by the vacuum packaging steps.

The above U.S. patent discloses a process to treat garments or the like to reduce or eliminate the tendency of the packaged garment to wrinkle, by exposing the garments to a treating atmosphere for extended periods of time e.g. three to seven days prior to packaging, so as to bring the garments into moisture equilibrium with an atmosphere corresponding to air at a relative humidity of 0–30% at a temperature of 25° C.

For commercial purposes, it may be undesirable to treat garments or the like for up to seven days prior to packaging since this involves a large amount of energy requirements, storage space or conditioning areas, etc.—it would be more advantageous to provide a conditioning process wherein the products to be vacuum packaged are conditioned within a shorter length of time so that, for example, upon their manufacture, they can be subjected to a conditioning step and immediately vacuum packaged without the necessity of utilizing lengthy conditioning times.

In accordance with this invention, it has been unexpectedly discovered that the conditioning time for fibrous materials, e.g. garments or, in general, textile materials can be greatly reduced to a matter of hours so that lengthy conditioning periods can be reduced significantly or avoided. As a result of this, garment or textile manufacturers can now utilize the conditioning steps of this invention in conjunction with an in-line operation for vacuum packaging their products.

More particularly, in accordance with one aspect of this invention, there is provided a method of conditioning fibrous materials such as textile materials of natural or synthetic origin, for vacuum packaging, which significantly reduces the tendency of such materials to wrinkle or crease upon release of the material from the vacuum packaging, by the steps of reducing the segment mobility level of the fibers of the fibrous material to a level below the segment mobility level of said fibers prior to said treatment and treating the material to reduce the relative moisture regain level of the fibers to a level below the relative moisture regain level of the material prior to said treatment.

In carrying out the method of the present invention, various embodiments may be employed to achieve the reduction in the level of segment mobility of the fibrous material and likewise to achieve a reduction in the level of the relative moisture regain of the fibers, as will be described hereinafter in greater detail.

In greater detail of the process and apparatus of the present invention, it has been found that the time required for conditioning textile materials, to reduce the susceptibility of the materials to wrinkle upon removal of the same from the vacuum package, can be achieved by controlling the segment mobility of the fibers of the textile material, whether natural or synthetic and as well the relative regain level of said fibers prior to packaging of the same, within a given parameter. Segment mobility of fibers, whether natural or synthetic, relates to the fiber molecules which are generally forcefully restrained by entanglement with other molecules, or by actual cross-linking between chains. However, deformation is still possible because of co-operative motions of local segments. The segmental motions in fibers are generally facilitated because amorphous polymers are rather inefficiently placed together in a superfluous space (free volume) present in the form of holes in the order of 10 Å diameter. These segments are set in motion when the fiber mass is supplied with heat and/or moisture and during a process of heating and/or treating any textile material with moisture, whereby the fibers gain moisture through absorption, the segment mobility of the fibers will achieve a given value before attaining a constant and relatively lower value. It is thus possible, in conjunction with the reduction in the level of the relative regain of the fibers, to shorten the length of conditioning time as otherwise proposed where it is desirable to expedite packaging of textile goods such as on an in-line basis from a manufacturing operation, for vacuum packaging purposes. Thus, with the present invention, by controlling this segment mobility, and the relative regain, during the critical period of conditioning a fibrous material prior to packaging, within given parameters, the textile materials can be rapidly and efficiently conditioned for vacuum packaging without having to wait for lengthy periods of time of e.g. several days. In other words, by controlling the segment mobility of the fibers during a conditioning process, together with the relative regain of the textile materials, the materials may be conditioned to a point suitable for vacuum packaging in a relatively short period of time so that the susceptibility of the textile materials to crease or wrinkle is reduced significantly upon the textile materials being removed from a vacuum package. Thus, in accordance with this invention, by controlling the segment mobility of the fibers of the textile materials in conjunction with the lowering of the moisture regain properties of the materials, shortened periods of conditioning may be achieved.

The term relative regain as used herein defines the amount of moisture regain of a fibrous material at a given relative humidity and is expressed as a value of the moisture regain of the same fibrous material at 99% relative humidity. This may be shown as:

$$\%\ \text{Relative (Moisture) Regain} = \frac{\text{Moisture Regain at a Given Relative Humidity}}{\text{Moisture Regain at 99\% Relative Humidity}}$$

In terms of this invention, the relative regain should always be lower than the amount of relative regain of the material prior to the material being conditioned and such relative regain should be brought into a substantially stable level in combination with the substantially stable level of the segment mobility prior to vacuum packaging.

In accordance with a further embodiment of this invention, it has also been found that by lowering the relative regain of a fibrous material within certain parameters, significant improvements in the fibrous material to resist wrinkling can also be achieved and to this end, more specifically, it has been found that if the relative regain level material is lowered by treatment in a gaseous environment below the relative regain level prior to treatment, and specifically to a level below about 0.32 one can achieve such benefits upon subsequent packaging, particularly vacuum packaging, of the commodity. This is quite unexpected in that heretofore, it has not been considered possible to obtain anti-wrinkling benefits by utilizing a relative regain below about 0.32. In this respecta most preferably the relative regain is brought to a level below about 0.27 and most desirable results have been found by utilizing relative regains below a factor of 0.22.

As outlined above, relative regain can be determined by the preceding equation; and moisture regain values for most fibrous products are known in the art and reference may be had to such standard information for determining the relative regain values for different materials which are to be employed in the method of the present invention.

The method of the present invention is applicable to the treatment of a wide range of fibrous materials, and in particular fibrous materials which are otherwise susceptible to wrinkling under conditions of packaging, storing or the like. The method finds particular application in the treatment of fibrous materials such as textile materials, e.g. clothes (coats, jackets, suits, etc.), sheets, etc. Such articles may be of a compressible nature and the present invention has many advantageous results with respect to compressible fibrous articles–e.g. textile products such as pillows, quilts, clothes or garments and with the method of the present invention, recovery from severe packaging conditions while substantially avoiding wrinkling can be achieved. It will be appreciated that there are many other types of commodities to which the present invention is applicable.

The method of the present invention may be carried out using any suitable apparatus achieving or suitable for performing the steps. Thus, suitable enclosure means with air circulation fans may be provided with means being provided for introducing conditioning air. One particular form of such means comprises the apparatus shown in copending application Ser. No. 909,930 filed May 26, 1978 or U.S. patent application Ser. No. 735,551, filed Nov. 1, 1976 in which the conditioning apparatus includes a tunnel with different treating zones, etc.

In addition, according to the above copending application, there may also be utilized in conjunction with the method of the present invention the vacuum packaging apparatus for vacuum packaging fibrous materials after treatment.

The type of packaging material employed for packaging treated products of the present invention may vary widely. Normally, the present invention may advantageously be used for the treatment and packaging of textile materials under vacuum. However, in the event of certain types of products intended to be used shortly after being conditioned by the present method, such products may be conventionally packaged in suitable packaging material and stored until use with improvements still being obtained in the property of the treated product. This would be applicable to products which are used shortly after manufacture, conditioning and storing.

In choosing a vacuum packaging material, and where storage times are contemplated, it is most desirable that such material be chosen so as to have a relatively low moisture vapour transmission rate to reduce moisture ingress into the vacuum packaged product which would otherwise deleteriously affect the product. Various types of plastic laminates may be used for this purpose suitably sealed to prevent air and moisture ingress. Other materials which may also be used include metallic foil, e.g. aluminum foil, etc.

In general, the segment mobility level of the fibrous material may be lowered in one of several ways—typically by treating the fibrous material with a gaseous atmosphere under conditions in which the atmosphere acts on the fibrous material to reduce the segment mobility level. To this end, the atmosphere may contain relative humidity conditions capable of reducing the segment mobility and/or in combination with temperature conditions may achieve similar results. Likewise, in reducing the relative regain level, the atmosphere may be varied by providing a gaseous environment of a type sufficient to cause the relative regain level to be lowered below a value of about 0.32.

Particularly preferred treatment conditions of the present invention involve exposing the fibrous material to be treated to a conditioning atmosphere containing a temperature lower than the initial ambient temperature of the fibrous material to be treated, which lower treating temperature may be maintained throughout the conditioning of the fibrous material or alternately, which may be decreased incrementally or otherwise throughout the conditioning treatment until such time as the segment mobility level has been lowered to a desired degree, or until such time as the segment mobility level has been stabilized, and in a like manner, until such time as the relative regain level is lowered to the desired degree or at least below 0.32, preferably 0.22 and preferably to a substantially constant level. In this preferred procedure it may be desirable to initially treat the fibrous material using substantially elevated temperatures, that is, temperatures in excess of the temperature at which the fibrous is subsequently subjected to for the purpose of initially reducing the relative regain at a faster rate and correspondingly while increasing the segment mobility during this initial phase. Thus, one procedure contemplated by the present invention involves two or more overall steps in which the initial step is a treatment step to initially subject the fibrous material to lower the relative regain, while increasing the segment mobility and thereafter in one or more subsequent stages of the initial treatment to lower the segment mobility and correspondingly to stabilize the relative regain, followed by a subsequent treatment to stabilize the segment mobility of the fibrous material.

Still further, the fibrous material may be initially treated under substantially constant temperature conditions, but with relatively low relative humidity conditions to progressively and incrementally decrease segment mobility and relative regain levels of the materials, while continuing such tretment until such time as such levels have been decreased below the levels initially involved and preferably, until such time as both have been stabilized.

In some cases, and for various types of fibrous textile materials, such as underclothes, face cloths, etc., vacuum packaging may be carried on at a point prior to complete stabilization of the segment mobility level of the material where such products need not be totally free of wrinkles for the sake of appearance. In this case, one may choose packaging conditions in which the product to be packaged has been conditioned to a point prior to segment mobility stabilization—and preferably with relative regain stabilization occurring at that point. However, for most fibrous materials such as suits or other like products, packaging should occur after the relative regain stabilization and segment mobility stabilization have set in—with a packaging operation, such as vacuum packaging, occurring at such levels and while such garments are maintained at such levels. In particularly preferred embodiments of the present invention, the fibrous materials are subjected to a conditioning atmosphere, preferably air, at relative humidities ranging from 0% to 48% and at temperatures ranging from about 0° C. to about 42° C., with more preferred conditions involving 0% to 40% relative humidity at temperatures ranging from about 0° C. to about 35° C. Such ranges of tempeature and relative humidity conditions for the treating atmosphere are applicable to a wide variety of products ranging from textile products which are of a synthetic or natural fiber construction to other products such as paper—e.g. wall papers, writing paper, etc. Particularly preferred temperatures and humidities for textile products such as clothing, gloves, etc., involve 0° C. to 35° C., and relative humidities of 20% or less for the conditioning atmosphere. Many textile products may be packaged at even lower relative humidity to expedite the relative regain stabilization or to achieve a relative regain value below 0.27, at e.g. 15–10% or less.

For various products such as textile materials, e.g. suits, coats, etc., two or more stages may be employed—i.e. the materials may be subjected to two or more conditioning steps one of which is a treatment step and other of which is a stabilization step. Stabilization temperature conditions are preferably relatively low, e.g. 25° C. or less and under relatively low relative humidity, e.g. 20% or less, while at the initial treatment stage, the previously described ranges will apply.

It will be understood by those skilled in this art that the temperature and relatively humidity conditions will vary depending on the nature of the material, the thickness of the fibrous material, the fiber type, etc.

The volume of conditioning air used to treat the garments will likewise vary considerably depending on the makeup of the fibrous materials, etc., as described herein. Normally, however, the fibrous material is treated with conditioning air in a volume sufficient to substantially maintain the conditioning air characteristics as close as possible to the ambient conditioning air characteristics at the surface of the fibrous material. In this way, the fibrous materials may be more efficiently treated as opposed to lower volumes which would cause non-conditioning air characteristics to occur adjacent the fibrous materials. To this end, the conditioning environment is preferably passed in a moving stream relative to the fibrous materials or alternately, the fibrous materials are passed in a direction of movement relative to the conditioning environment sufficient to cause the conditioning environment to maintain the conditioning effect adjacent the surface of the fibrous material.

Using the above conditions, the fibrous materials may be treated under normal circumstances to achieve a constant segment mobility stabilization and a constant relative regain stabilization in a period of 5 hours or less, typically 2 or 3 hours. Textile materials such as coats, etc., may be treated within 1 hour to arrive at stabilized segment mobility and relative regain levels.

Most preferably, in employing treatment conditions in which the segment mobility level is lowered by a first treating atmosphere involving one or more stages, and/or the relative regain is lowered below its initial level, in said one or more stages, and where such treating stage is followed by a stabilization step with one or more stages, the stabilization step is preferably carried out for a period of time ranging from 0.1:1 to about 1:0.1 of the time involved in the treating step. Desirably, this is within the range of 0.5:1 to about 1:0.5. Under such conditions, the stabilizing atmosphere is preferably at 0°–20° C. and a relative humidity of 0–15%.

Having thus generally described the invention, reference will now be made to the accompanying drawings, in which.

In all of the following tests, temperature measurements are expresed in degrees Centigrade with the standard deviation being plus or minus 2° C.

Figure 1:
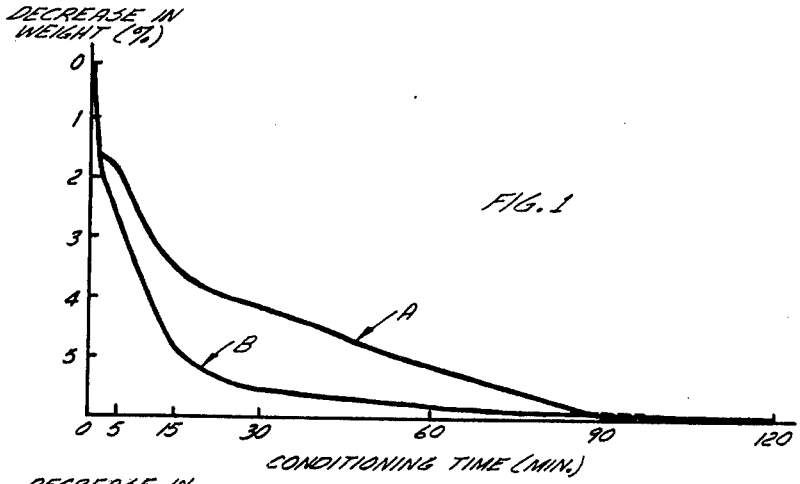
FIG. 1 shows a graph of results of experiments carried out at different temperatures and relative humidity for a cottom fabric relating to the removal of moisture under such conditions.
Figure 2:
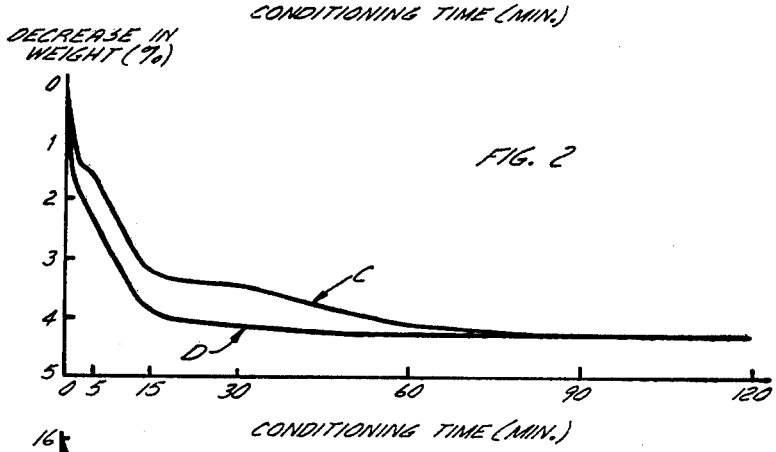
FIG. 2 is a similar graph to that of FIG. 1 but showing the removal of moisture relative to a Nylon fabric.
Figure 3:
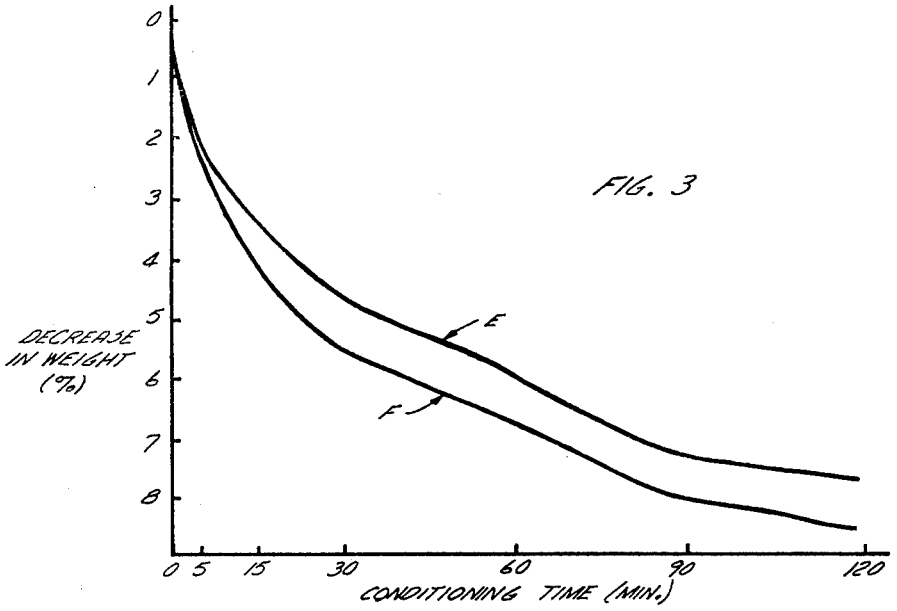
FIG. 3 is a graph similar to FIG. 1 showing similar results relative to a wool fabric.

Referring now to FIGS. 1 through 3, the graphs illustrate the results of experiments relating to various types of synthetic and natural fibrous materials and more specifically, cotton, nylon and wool materials, respectively. Each of these materials was treated under conditions specified hereinafter by employing samples which were initially tested for initial moisture regain, and then conditioned under the treatments subscribed hereinafter. Each of the graphs thus illustrates, in summary, that various temperatures will remove varying amounts of moisture from the products and will achieve stabilized moisture content after varying times.

More specifically, with respect to FIG. 1, summarizing results of several tests, the following procedures were employed:

Samples of 100% pure cotton fabric were employed in which the samples were measured to obtain, at the onset of the tests, 85% relative humidity which corresponds to an initial regain factor of 9.1%. Such samples were exposed to a flow of conditioning air at 28° C. and 11% relative humidity and a second group of the same samples at 35° C. and 11% relative humidity. Conditioning air treatment was carried out for periods up to 120 minutes with intermittent measurements of decrease in the weight percentage of the cotton fabric at various periods of time through the tests. As will be seen from FIG. 1, the samples treated at 28° C. and 11% relative humidity shown by the curve A became substantially stabilized at about 90 minutes, while the samples treated at 35° C. shown by the curve B stabilized somewhat earlier—approximately 75 minutes, under the same relative humidity. Increasing temperatures, at the same relative humidity, with thus be seen to decrease the absorbed water of the samples at an earlier point in time.

Similar results are obtained with reference to FIG. 2 which illustrates the results of tests using substantially identical conditions to FIG. 1, but in this case with pure nylon fabric as having an initial relative humidity of 85%, and an initial regain of 5.5%. In this case, reference letter C designates the curve for material treated at 28° C. and reference letter D material treated at 35° C., with the material being treated at the higher temperature becoming stabilized relative to the decreased amount of moisture at approximately 40 to 45 minutes and that treated at a lower temperature became stabilized slightly above 90 minutes.

In FIG. 3, similar tests (using 100% pure wool fabric) under similar conditions were carried out, as illustrated with respect to the results shown in FIG. 1. Reference letter E illustrates the results obtained at 28° C. under 11% relative humidity and reference letter F the results of similar relative humidity at 35° C. Stabilization for the various samples of both the higher and lower temperatures was in excess of 120 minutes, with the samples having an initial regain of 15.9% corresponding to an initial weight measurement at 85% relative humidity.

Figure 4:
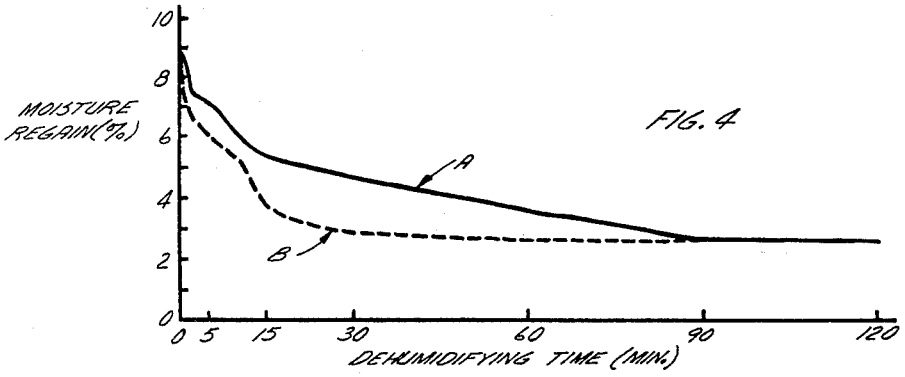
FIG. 4 is a graph illustrating the decrease in moisture regain values relative to a conditioning time factor for the material of FIG. 1.

FIG. 4 illustrates the summary of tests relating to the factor for achieving moisture regain stabilization with respect to the samples shown in FIG. 1. Thus, with the initial regain measurements of the materials used in FIG. 1, which was 9.1% the moisture regain values for the materials for FIG. 1 over the test ranges show stabilization beginning shortly after 30 minutes of treatment and subsequently stabilizing at 50 to 60 minutes for the measurements of samples indicated by reference letter B under the temperatures and conditions illustrated with respect to FIG. 1. In a similar vein, the samples shown by the curve A of FIG. 4 indicates stabilization beginning at approximately 90 minutes with the moisture regain measurement of those samples treated with a lower temperature.

Figure 5:
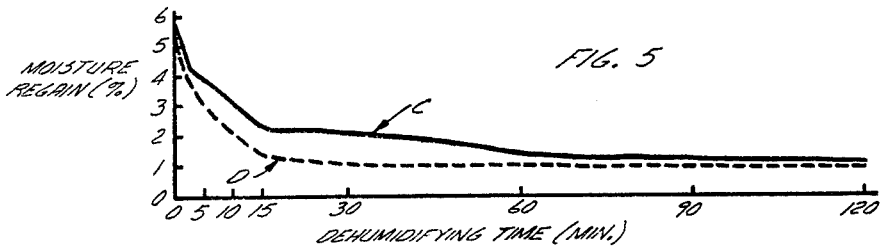
FIG. 5 is a graph similar to that of FIG. 4, but relating to the nylon material of FIG. 2.

In FIG. 5, moisture regain curves for the samples of FIG. 2 are shown and again, indicated by reference letters C and D (for nylon) show the moisture regain stabilization under such conditions as were employed in treating the samples of FIG. 2, to involve stabilization for the moisture regain values, for the materials shown by the curve of reference letter C, with stabilization being at approximately 90 minutes and for the curve D at approximately 40–45 minutes.

Figure 6:
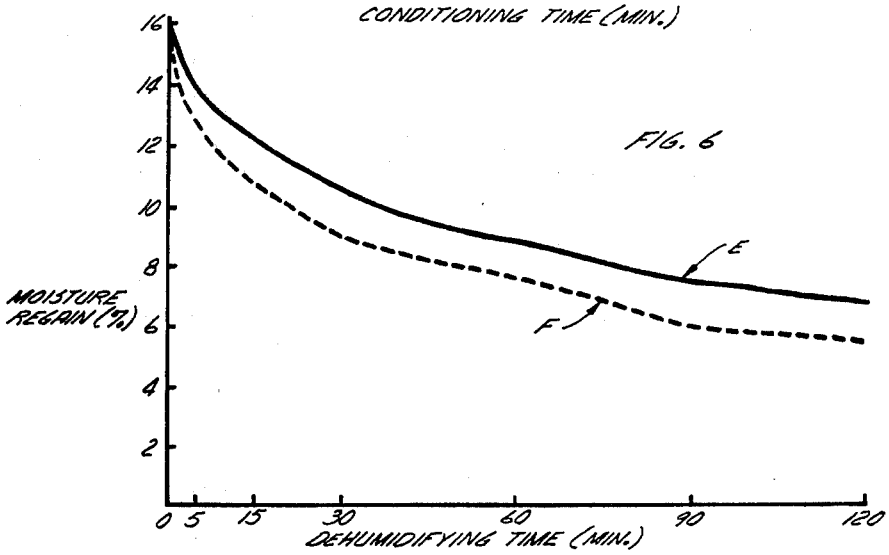
FIG. 6 is a graph similar to that of FIG. 4 but wich reference to the wool material of FIG. 3.

Likewise, the stabilization of moisture regain for the material shown in FIG. 3, and as illustrated in FIG. 6, for the curve E illustrates that a higher temperature treated material will stabilize in excess of 120 minutes, as will the material treated at the lower temperature which will likewise stabilize in excess of 120 minutes, due to the nature of the material and the initial moisture content of the product.

From the above, it will be noted that moisture regain reduction will stabilize for varying materials at varying times, with stabilization being shown by a substantially constant measurement, which in turn, will yield a substantially constant relative regain value in all cases below about 0.32 in terms of the equation previously expressed in this case.

Figure 7:
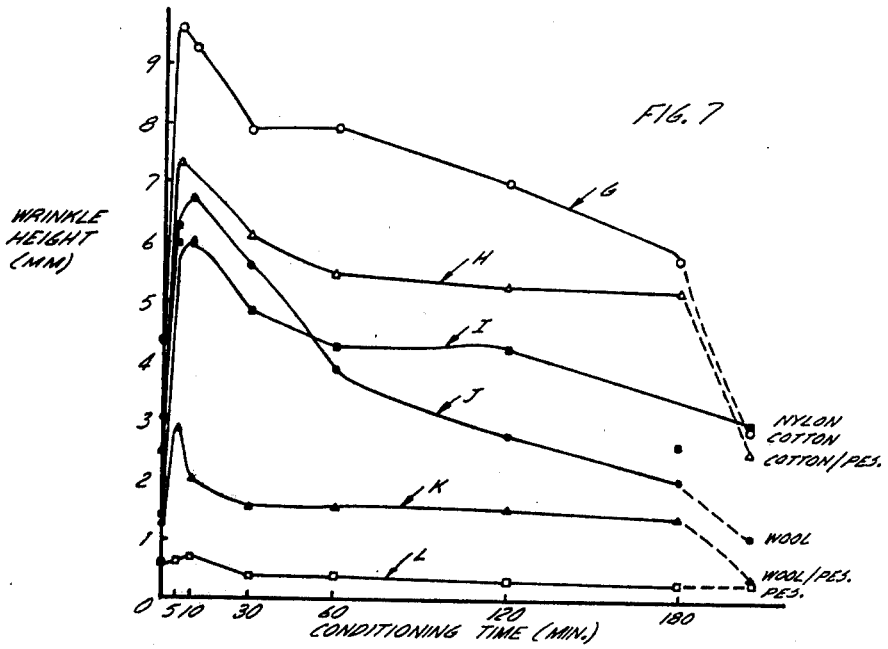
FIG. 7 is a graph relating to the wrinkling results relative to conditioning time showing the segment mobility stabilization curves of various materials under certain treatment conditions.

Referring now to FIG. 7, there is illustrated a graph summarizing the results of tests carried out to determine the propensity of various types of materials to wrinkling, which tests simulate the results of wrinkling as encountered in packaging, particularly vacuum packaging, of various types of commodities made from different types of natural and synthetic materials.

The results of the tests illustrated in FIG. 7 were based on test procedures involving samples of the materials indicated. The samples were treated initially in air at 85% relative humidity until moisture regain equilibrium at that humidity was obtained. Each of the samples were then humidified for different periods of time ranging from 0 to 180 minutes with the samples being in an undeformed state. In FIG. 7, conditioning of the samples using atmospheric air was carried out with the atmospheric conditions involving, for the results shown in FIG. 7, 40% relative humidity and 35° C. with a constant flow rate of atmospheric air at 15 liters per minute. At intervals of 5, 10, 30, 60, 120 and 180 minutes, the samples were tested by loading the respective samples in a conic wrinkling tester for a period of 10 minutes using a load of 2 kg. Thereafter, the wrinkled samples were permitted to recover in atmospheric air at 65% relative humidity and 20° Cå with wrinkle height (wrinkle recovery) then being measured using a load of 5 grams after 5–15 minute recovéry periods.

The results of the above tests for the different time periods are plotted in the form of the curve shown in FIG. 7 and illustrate those conditions approximating treatment of the samples to illustrate the wrinkle factor such as would be encountered in vacuum packaging at various levels of segment mobilities of the fibers of the fibrous materials involved. Thus from FIG. 7, the state of, or level of, segment mobility of the different materials will be evident.

The materials involved in the tests shown by the curve of FIG. 7 included 100% nylon, the results of which are shown by the curve of reference letter G; 100% cotton the results of which are shown by the curve of reference letter H, a blend of nylon and polyester fibers the results of which are shown by the curve indicated by reference letter I, pure wool the results of which are shown by the curve designated by reference letter J, a mixture of wool and polyester fibers the results of which are shown by the curve designated by reference letter K and finally 100% polyester the results of which are shown by the curve defined by reference letter L.

FIG. 7 also illustrates, on the horizontal axis, the results of extended periods of testing showing the point at which the segment mobility levels in the different materials have been stabilized.

As will be seen from the results shown on FIG. 7, segment mobility stabilization indicated by an absence of wrinkling under the test conditions can be achieved in a relatively short period of time. However, under the conditions specified using conditioning air at 35° C. with 40% relative humidity, segment mobility stabilization for materials such as cotton, cotton mixtures and nylon were longer.

By varying the treatment conditions, according to a further set of experiments, segment mobility stabilization can be achieved at a greater rate. To this end, the results shown in FIG. 8 are the results of tests carried out on substantially identical samples to those used with respect to the experiments of FIG. 7 but in this case, the conditioning atmosphere involved treatment using 15 liters of conditioning atmosphere per minute having a relative humidity of 10% and again at 35° C. starting with the samples having an initial relative humidity in equilibrium with air at 85% relative humidity and 20° C.

Figure 8:
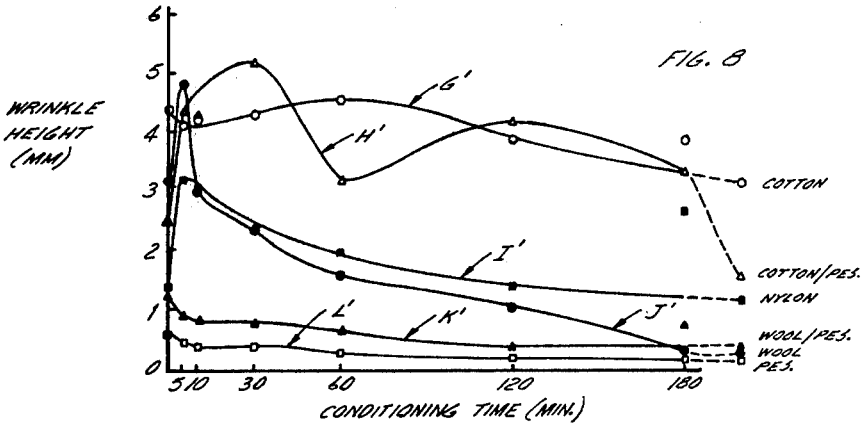
FIG. 8 is a graph similar to FIG. 7 showing similar results but under different treatment conditions.

Similar letter designations, shown by the corresponding letters G', H', etc., in FIG. 8 indicate similar materials to those of FIG. 7 and in this case it will be seen that the segment mobility levels of various materials initially climbed or were increased prior to decreasing along their respective curves. Segment mobility for wool, polyester, wool-polyester and nylon became substantially stabilized in relatively short periods of time indicating that the segment mobility had become stable at which time the products of these materials could be vacuum packaged without semi-permanent wrinkling being set into the material.

The results of numerous other similar tests, similar to those shown in FIG. 7 and 8 have illustrated that for varying conditioning atmospheres, segment mobility stabilization can be achieved but that until such time as segment mobility stabilization is achieved, products packaged (as summarized by the conic testing methods) would have semi-permanent deformations therein which of course is totally undesirable. From such tests, segment mobility stabilization for the materials of FIGS. 7 and 8 can be seen to form stabilized conditions by varying the treating temperature and in general, earlier segment mobility stabilization can be achieved by initially utilizing conditioning temperatures which initially lower the relative regain values of the samples to a substantially stabilized level whereafter the conditioning atmosphere utilizing lower temperatures to provide stabilized segment mobility will result in combined stabilized relative regain levels and stabilized segment mobility levels.

Figure 9:
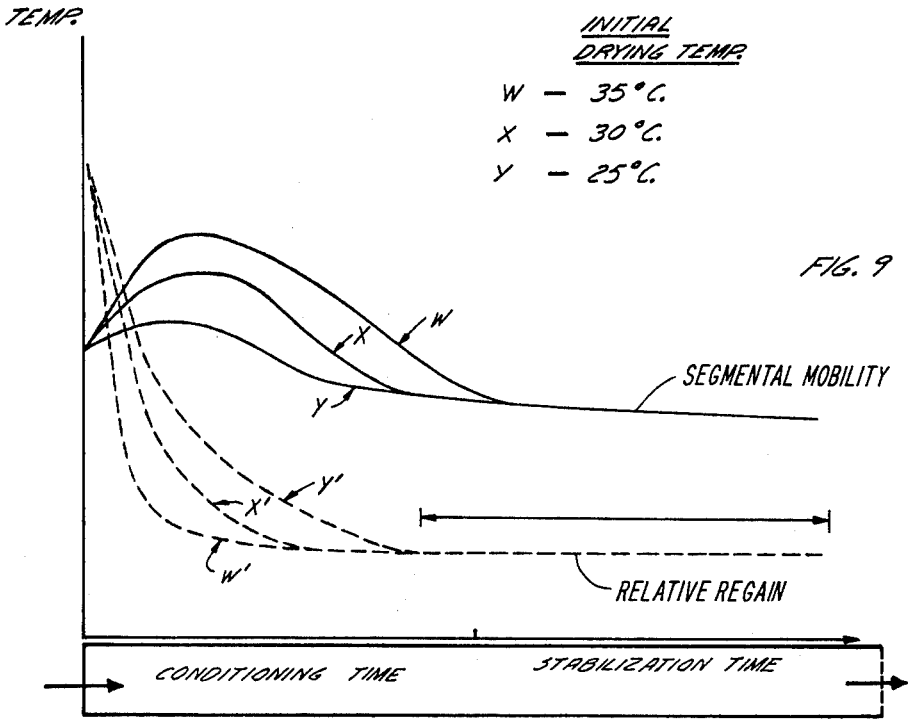
FIG. 9 is a graph showing the segment mobility curves for various temperatures and relative regain curves for such temperatures, under given conditioning parameters.

This is illustrated in greater detail in FIG. 9 which clearly shows the combined results of relative regain and segment mobility factors relative to the propensity to wrinkle. In FIG. 9, curve W illustrates the use of initial conditioning temperatures at 35° C. on samples of fibrous material, curve X the use of conditioning air at 30° C. on samples of the same material and curve Y the results of the use of conditioning atmosphere at 25° C. and in which the initial samples being treated by the conditioning air contain 65% relative humidity at 20° C. Correspondingly, the relative regain curves illustrate, under similar conditions to those described above, the relative regain for the temperature curves W, X and Y, but in this case, the respective relative regain curves are designed by W', X' and Y'. With respect to the samples having the above initial conditions (65% relative humidity), those treated with conditioning atmosphere having a 35° C. temperature measurement and a nominal 30% relative humidity (curve W) show an increased segment mobility in the fibrous material after initially being treated by the conditioning atmosphere and a subsequent decrease until a substantially stabilized segment mobility is obtained which is at a level below the segment mobility level of the material prior to treatment. Correspondingly, the relative regain, curve W' shows an initial significant decrease, as shown by the earlier figures and thereafter achieves a substantially stabilized condition in advance of the segment mobility stabilization. At the point where the relative regain and the segment mobility levels of the fibrous material are substantially constant, the fibrous material may be packaged by e.g. vacuum packaging without suffering any deleterious effects.

Similar results are shown by the curves X and X' which at lower conditioning temperatures and similar nominal relative humidity values, indicated a lower rise in segment mobility with a shorter period of time before segment mobility stabilization was achieved, but conversely, slightly longer times were required for relative regain stabilization.

In this latter case, however, relative regain stabilization was still achieved prior to segment mobility stabilization, and again both the relative regain and segment mobility stabilization levels using the conditioning atmosphere were at a point below the original level of the materials being treated.

Curves Y and Y' show similar results and at lower temperatures, but lower initial segment mobility increases are encountered but with greater relative regain times involved prior to stabilization for relative regain.

In all of the above cases, once stabilization of segment mobility had been achieved and with relative regain stabilization, conditioning was carried on using conditioning air under substantially constant conditions—e.g. 20° C. and 10% relative humidity, to maintain stabilization. At this point, garments or the like of such materials can be safely vacuum packaged without detrimental wrinkling being permanently or semi-permanently set in the material.

With reference to the above examples conical wrinkling is known in the art and reference may be had to "Wrinkle Recovery Properties of Cotton Fabrics at Chainging Moisture and Temperature Conditions", SIRTEC, Symposium International de la Recherche Textile Cotonniere, Paris, Apr. 22–25, 1969 for the procedures involved.

The following example illustrates one embodiment of the method of the present invention, in which the method utilized different conditioning air environments.

This example was carried out using the apparatus of the above-mentioned copending application, and in the treatment zone of such apparatus, conditioning air was provided ranging from 30° C. to 20° C. and containing 30–15% relative humidity while in the stabilization zone, conditioning air was introduced ranging from 20° C.–15° C. and 12–5% relative humidity.

Numerous tests have been carried out under such conditions using various types of fibrous materials—e.g. textile products in the form of garments, pillows, and the like.

In one such test, men's suits of 100% wool were introduced into the apparatus, with the ambient atmospheric conditions being at that point approximately 30° C. and 60% relative humidity. The garments were initially treated with conditioning air using such air at the rate of 400 liters/second. In the stabilization zone, conditioning air was introduced at the rate of 200 liters/-second. Air temperatures in the initial portion of the treatment zone were approximately 30° C. decreasing to approximately 20–15° C. and with the air in the stabilization zone being maintained at a constant 15–20° C.

The garments were treated in the treatment zone until such time as the segment mobility of the wool material was substantially stabilized and likewise the relative regain come to a substantially stable level. Thereafter, the garments were maintained in such stabilized condition for approximately 30 minutes with a total conditioning time being approximately 60 minutes.

In the method, after continuous running, conditioning air was introduced using a mixture of ambient air and treated air so that the mixture obtained was one in which the relative humidity varied from approximately 30% at the initial stage of the treatment zone to approximately 15% at the end of the treating zone while in the stabilization zone the relative humidity was maintained at a constant 10%.

The apparatus employed according to the copending application had the following characteristics: the length of the treatment zone was approximately 10 meters with the height of the whole system being approximately 2 meters and having a width of approximately 80 centimeters. The stabilization zone had a length of approximately 10 meters and air was removed at a constant volume of approximately 480 liters per second (with a total of 1200 cubic meters per hour being removed from both zones).

Upon exiting from the stabilization zone, the garments were tested and found to contain a relative regain of below 0.22.

The garments were subsequently wrapped and vacuum packaged using the apparatus described in the copending application. The volume of such garments was reduced under vacuum packaging to about ⅓ to ½. They were thereafter stored for one week and the vacuum packaging removed. The garments were tested to determine the wrinkle characteristics and such garments were found to be substantially free from wrinkles by employing the method of this invention.

If desired, following removal of the vacuum packaging and in order to expedite recovery of the garments from this compressed state to their normal original condition, the product may be re-conditioned by exposing the same to relative humidities of 50% or greater and temperature conditions of 25 to 45° C. However these relative humidities and temperature conditions will vary depending on the type of product, the nature of the fibrous materials, etc.

I claim:

1. A method of conditioning fibrous material of natural or synthetic nature for vacuum packaging, comprising the steps of treating said fibrous material to reduce the relative regain of the fibers of the fibrous material to a level below the relative regain level of said fibrous material prior to said treatment, reducing the segment mobility level of the fibers of the fibrous material to a level below the segment mobility level of said fibers prior to said treatment and packaging said material while said relative regain level and said segment mobility level of the fibers of the fibrous material is at a level below the respective levels prior to said treatment.

2. A method as defined in claim 1, wherein said treating of said fibrous material is carried out by providing a fibrous material with a first segment mobility and first relative regain level, and exposing said fibrous material to a gaseous environment to lower said segment mobility level and said relative regain level to a second level below said first level and continuing the exposure of said fibrous material to said gaseous environment until the segment mobility level and the relative regain level is substantially constant.

3. A method as defined in claim 1, wherein said fibrous material is treated by exposing said fibrous material to a gaseous environment having a temperature sufficient to reduce the segment mobility level of the fibers of the fibrous material to said level below the level prior to said treatment and to reduce said relative regain level to a level below said level prior to said treatment.

4. A method for conditioning and packaging a compressible article comprising the steps of successively exposing said article to first and second atmospheres, the temperature of said first atmosphere exceeding the temperature of said second atmosphere and the relative humidities of said first and second atmospheres being selected to provide a decrease in the relative humidity of said article throughout the course of such conditioning, and vacuum packaging said article while said article has temperature and relative humidity established by said conditioning.

5. In a method of packaging a fibrous material of natural or synthetic nature, the improvement comprising treating said product to reduce the relative regain of said product to a level below the relative regain prior to said treatment, and to a value of not more than about 0.27, and subsequently packaging said fibrous material at or below said level.

6. A method as defined in claim 5, wherein the relative regain is reduced to a substantially constant level, and wherein said product is treated to reduce the segment mobility level of said fibrous material to a level below that prior to said product being treated and until the segment mobility level has reached a substantially constant level.

7. A method as defined in claim 5, wherein the relative regain level of said fibrous material is reduced by exposing said fibrous material to a gaseous encironment having a substantially constant temperature, but with a relative humidity sufficient to lower said relative regain level of said fibrous material to a point where said relative regain level maintains a substantially constant level.

8. A method as defined in claim 5, wherein said material being treated is a textile material.

9. A method as defined in claim 5, wherein the treatment step initially increases the segment mobility level of the material to a level above the level prior to treatment, and subsequently decreasing said segment mobility level to below the level prior to said treatment, said treatment reducing the relative regain to a substantially constant level prior to said packaging step.

10. A method of conditioning fibrous material of natural or synthetic nature for vacuum packaging comprising the steps of exposing said material to a gaseous environment for a sufficient period of time to treat said fibrous material to reduce the relative regain of the fibers of the fibrous material to a level below about 0.32 and reducing the segment mobility level of the fibers of the fibrous material to a level below the segment mobility level of the fibers prior to said treatment.

11. A method as defined in claim 10, wherein said gaseous encironment is atmospheric air, said air being conditioned to lower said segment mobility level and said relative regain level.

12. A method as defined in claim 10, wherein said segment mobility of said fibrous material is lowered from an initial level to a preselected level by exposing said material to a gaseous environment having a temperature lower than the temperature of said material prior to said treatment.

13. A method as defined in claim 10, wherein said segment mobility of said fibrous material is lowered from an initial level to a preselected level by exposing said material to a gaseous environment having a relative humidity lower than that of the material prior to treatment.

14. A method as defined in claim 10, wherein said segment mobility of said fibrous material is lowered from an initial level to a preselected level by exposing said material to a gaseous environment having a temperature lower than the temperature of said material prior to said treatment, and a relative humidity lower than that of the material prior to treatment.

15. A method of conditioning fibrous material of natural or synthetic nature for vacuum packaging comprising the steps of treating said fibrous material by exposing said material to atmospheric air in an initial treatment zone and subsequently in a stabilizing zone, said fibrous material being treated in said treatment zone to reduce the relative regain of the fibers of the fibrous material to a level below the relative regain level of said fibrous material prior to said treatment, and reducing the segment mobility level of the fibers of the fibrous material to a level below the segment mobility level of said fibers prior to said treatment, and continuing the treatment of said fibrous material until said segment mobility level of said material maintains a substantially constant level and until said relative regain level maintains a substantially constant level, and thereafter maintaining said substantially constant segment mobility level and said relative regain level for a period of time ranging from about 0.1:1 to about 1:0.1 of the time said material was initially treated.

16. A method as defined in claim 15, wherein said fibrous material is initially treated at a temperature of about 0° C. to about 50° C., and said fibrous material is subsequently treated at a temperature of about 0°–40° C.

17. A method as defined in claim 15, and in which the atmosphere has a relative humidity of about 1% to about 30%.

18. A method of conditioning textile materials of natural or synthetic origin, for vacuum-packaging, which reduces the tendency of such materials to wrinkle or crease upon release of the materials from the vacuum-packaging, by the steps of exposing the fibrous material to a gaseous encironment containing air at a temperature sufficient to reduce the segment mobility of the fibers of the fibrous materials to a level below the segment mobility level of the said fibrous materials prior to being exposed to said gaseous environment, said conditioning being carried out for a time period of up to 240 minutes, and stabilizing said treated materials by maintaining said segment mobility of said materials at a level below the level of the segment mobility of said first step under gaseous conditions of less than about 20% relative humidity and at a temperature of less than about 38° C., said stabilization step being carried out for a period of time of between 0.1:1 to about 1:01 of the time factor that the materials have been subjected to in said conditioning step, and subsequently packaging said material.

19. A method as defined in claim 18, wherein said material is packaged under vacuum conditions in a flexible wrapping material having a low moisture vapor transmission rate.

20. A method as defined in claim 18, wherein said stabilizing treatment is carried out for a time ratio of from about 0.5:1 to about 1:05 relative to the time the textile material has been treated in the conditioning step, said material being treated for up to a total of 4 hours.

21. A method as defined in claim 18, wherein said material is treated in said treatment zone for a period ranging from about 2 minutes to 2 hours and in said conditioning zone for a period of about 2 minutes to 2 hours.

22. A method of conditioning fibrous material of natural or synthetic nature, said fibrous material being initially exposed to an atmosphere at an elevated temperature, said atmosphere having a relative humidity lower than the relative humidity of the fibrous material, and thereafter treating by exposing said fibrous material to an atmosphere at a temperature lower than the temperature of said elevated temperature, and having a relative humidity lower than the relative humidity of the material prior to said treatment, said material being exposed to said last-mentioned atmosphere for a period of time sufficient to provide a substantially stable relative regain level and to provide a substantially stable segment mobility level, and thereafter said material is packaged at or below said substantially stable levels of relative regain and segment mobility of the material.

23. A method as defined in claim 22, wherein the relative regain is reduced to a level below 0.32.

24. A method of conditioning fibrous material of natural or synthetic nature for vacuum packaging comprising treating by exposing said fibrous material to conditioning air having substantially the same relative humidity as said fibrous material, said conditioning air having a temperature lower than the temperature of said fibrous material prior to treatment with said conditioning air, and reducing the relative regain of the fibers of the fibrous material to a level below the relative regain level of said fibrous material prior to said treatment, and reducing the segment mobility level of the fibers of the fibrous material to a level below the segment mobility level of said fibers prior to said treatment.

25. A method of conditioning fibrous material of natural or synthetic nature for vacuum packaging comprising the step of treating said fibrous material to reduce the relative regain of the fibers of the fibrous material by conditioning said material in at least two different atmospheres and in which at least one subsequent atmosphere to the first of said two atmospheres has a relative humidity lower than that of the preceding atmosphere, said fibrous material being exposed to said atmospheres for a period of time sufficient to lower the relative regain of the fibrous material to a level below about 0.27, and reducing the segment mobility level of the fibers of the fibrous material to a level below the segment mobility level of the fibers prior to said treatment.

26. A method of conditioning fibrous material of natural or synthetic nature for vacuum packaging comprising the steps of reducing the segment mobility level and the relative regain level of the fibers of the fibrous material by exposing said material to atmospheric air, the reduction of the relative regain level of the fibrous material being to a level below about 0.27 and the segment mobility level being reduced to a level lower than the segment mobility level of the material prior to treatment, and subsequently packaging said material when said segment mobility and said relative regain levels are at or below such levels.

* * * * *